US005781012A

United States Patent [19]

Yasuda

[11] Patent Number: 5,781,012

[45] Date of Patent: Jul. 14, 1998

[54] ION CURRENT DETECTING APPARATUS FOR INTERNAL COMBUSTION ENGINES

[75] Inventor: Yukio Yasuda, Tokyo, Japan

[73] Assignee: Mitsubishi Denki Kabushiki Kaisha, Tokyo, Japan

[21] Appl. No.: 733,151

[22] Filed: Oct. 16, 1996

[30] Foreign Application Priority Data

Mar. 28, 1996 [JP] Japan ..... 8-073806

[51] Int. Cl.[6] ..... F02P 17/00

[52] U.S. Cl. ..... 324/399; 324/388

[58] Field of Search ..... 324/388, 399, 324/392, 393, 402, 378; 73/35, 116; 123/425

[56] References Cited

U.S. PATENT DOCUMENTS 5,561,239 10/1996 Yasuda .
5,563,332 10/1996 Yasuda .

FOREIGN PATENT DOCUMENTS 7-217519 8/1995 Japan .

*Primary Examiner*—Maura K. Regan
*Attorney, Agent, or Firm*—Leydig, Voit & Mayer, Ltd.

[57] ABSTRACT

An ion current detection apparatus for detecting an ion current caused by combustion in a cylinder of an internal combustion engine comprises an ion current detection circuit for detecting the ion current, a gain adjustment circuit for controlling to keep the magnitude of low frequency components of the detected ion current at a constant value, an amplifier for amplifying high frequency components of the detected ion current and outputting a high frequency component detection signal, a magnitude detection circuit for detecting the magnitude of the detected ion current to output an ion current detection signal when the detected magnitude is larger than a predetermined value, and a comparator for comparing the high frequency component detection signal with the ion current detection signal delayed by a delay circuit to output a knocking detection signal.

8 Claims, 11 Drawing Sheets

ION CURRENT DETECTING APPARATUS FOR INTERNAL COMBUSTION ENGINES

BACKGROUND OF THE INVENTION

1. Field of the Invention

The present invention relates to an ion-current detecting apparatus that detects the state of combustion in an internal combustion engine by detecting ion current generated by combustion in the internal combustion engine.

2. Description of the Related Art

In an internal combustion engine, a mixture of air and fuel taken into a combustion chamber, hereinafter referred to as a cylinder, is compressed by a piston, and burned by an electric spark of an ignition plug installed in the cylinder, so that the power generated on the piston by the explosion caused by the burning is taken as output.

When combustion takes place in a cylinder, the molecules inside the cylinder are ionized. If a high voltage is applied to the inside of the cylinder in such an ionized state, a current flows by the motion of ions having electric charges. This current is called ion current. Ion current sensitively varies depending on the combustion state inside a cylinder, so that the combustion state can be detected by detecting the state of the ion current. As a system using the ignition plug for the electrode for detecting ion current, there is an invention disclosed in the Japanese patent laid-open publication No. Hei 7-217519. The invention realizes an apparatus that detects the misfiring (knocking) state, in which combustion does not normally take place, based on the magnitude of ion current immediately after ignition.

Further, concerning the control of ignition timing in internal combustion engines, there has been widely used a method of control that prevents knocking, by detecting abnormal vibration caused by knocking and by varying ignition timing, while maintaining ignition timing that brings high power. For example, a sensor that detects vibration is installed inside an internal combustion engine, so that an electric vibration signal obtained by the sensor is analyzed in a computer, and ignition timing is made earlier to stop knocking, if knocking occurs.

However, the source of knocking is the cylinders. In order to detect vibration from a plurality of cylinders by a single vibration sensor, the position of the vibration sensor is a crucial factor. An optimal position of a vibration sensor that easily detects vibration from cylinders and does not detect the vibration of other parts such as intake and exhaust valves depends on each engine, so that mandays for designing an engine are increased to determine the optimal position.

It is known that vibration due to knocking is also demonstrated in the oscillation in the waveform of an ion current signal. Therefore, if the ion current signal is used for knock control then, compared with the method of detecting knocking by a vibration sensor in the form of the vibration of a whole engine, differences among engines are reduced, and vibration sensors become unnecessary. Hence, a control system can be constructed with great accuracy and at low cost.

In an apparatus described above for detecting a misfiring state, the magnitude of the ion current greatly varies depending on the speed of the internal combustion engine, so that the detection of a knock signal superimposed in the waveform of the ion current signal for the whole range of engine speed has been difficult.

In a prior detector of a misfiring state using an ion current detecting apparatus, if the detected magnitude of ion current is greater than or equal to a constant value, then it is judged that combustion in the cylinder has taken place normally. If the detected magnitude of ion current is less than the constant value, then it is judged that combustion in the cylinder has not normally taken place. However, in a misfiring state, the magnitude of ion current does not necessarily become zero. In particular, when engine speed is high, the magnitude of ion current becomes great, so that ion current of the same magnitude as detected during a normal state of low engine speed can, in some cases, be detected during a misfiring state of high engine speed. Therefore, if the threshold value of ion current for judging misfiring and firing is set for low engine speed, then misfiring cannot be detected during high engine speed, since detected current is over the threshold value during misfiring of high engine speed. If the threshold value of ion current is set for high engine speed, then firing cannot be detected during low engine speed even if combustion is normally taking place, since the magnitude of ion current becomes small during low engine speed. In order to solve these problems, there is an invention disclosed in Japanese Patent laid-open publication No. Hei 7-217519. In this invention, if ion current is detected, then a current depending on the detected current is made to flow into a capacitor to feed back a current corresponding to the capacitor's holding voltage and cancel the detection of the current. By this means, the minimum level of ion current needed for detection is increased, as more ion current is detected, so that false detection is prevented. However, ion current is hardly generated during misfiring, so that this method cannot prevent a failure in the detection of misfiring.

Further, in a prior ion current detecting circuit, constructed as above, the rate of conversion from ion current to ion voltage is constant, so that the knock signal superimposed in the waveform of ion current, which greatly varies with the speed of the internal combustion engine, is hard to detect for the whole range of engine speed. Therefore, application of ion current to knock control has been hampered.

Further, in the invention disclosed in Japanese Patent laid-open publication No. Hei 7-217519, its circuitry requires an operational amplifier, so that the circuitry becomes large.

SUMMARY OF THE INVENTION

The present invention is intended to solve the above problems. Its object is therefore to provide an ion current detecting apparatus that comprises a small number of circuitry elements and that is able to detect both misfiring and knocking by detecting ion current.

A first ion current detecting apparatus in accordance with the present invention is an apparatus that detects ion current generated during burn time, in an internal combustion engine comprising ignition coils that generate high voltage on their secondary winding by a voltage applied to their primary winding, ignition plugs that fire by the voltage generated on ignition coils, and cylinders. The ion current detecting apparatus is equipped with a voltage generator for detection that comprises a first diode whose anode is connected to the primary winding of the ignition coils, a first capacitor whose one end is connected to the cathode of the first diode and that is charged by the voltage generated on the primary winding of the ignition coils, and a second diode whose anode is connected to the other end of the first capacitor, whose cathode is grounded, and that forms a path for charging current together with the first diode and the first capacitor during the time when the first capacitor is charged and an ion current voltage converter having a current mirror circuit that takes in the ion current generated inside the cylinders by applying the voltage generated by the discharging of the first capacitor to the ignition plugs and that outputs a current equivalent to the ion current and an output circuit that converts the output current of the current mirror circuit into voltage to output.

In the above ion current detecting apparatus, during the firing of an ignition plug, a current flows through the path of ignition plug, the first diode, the first capacitor and the second diode, so that the capacitor is charged. During ion current detection, the first capacitor is discharged by a current flowing either through the path of the power supply, the current mirror circuit, the first capacitor, the ignition plug or through the path of power supply, the current mirror circuit→first capacitor→ignition coil→ignition plug, so that a voltage for ion current detection is applied to the inside of the cylinder. When ion current is generated, the ion current flows into the current mirror, and an equivalent current is output and converted by the output circuit into a voltage.

Preferably, in the first ion current detecting apparatus, the output circuit is composed of a resistor, and the output current of the current mirror circuit flows through the resistor, so that the converted voltage is output as a voltage drop at the resistor.

Preferably, in the first ion current detecting apparatus, the output circuit is equipped with a constant current circuit comprising a current mirror circuit. Then a converted voltage is obtained from the relativity of the current determined by the constant current source and the ion current.

Preferably, the first ion current detecting apparatus is further equipped with a gain adjustment means that controls the rate of conversion from ion current to output voltage in the ion current voltage converter and a high frequency component amplifier that converts the component currents of frequencies not less than a predetermined frequency and superimposed in the waveform of ion current into voltage to output. The gain adjustment means comprises a reference voltage circuit that generates a predetermined reference voltage, a first differential amplifier whose one input terminal is connected to the output terminal of the ion current voltage converter and whose other input terminal is connected to the output terminal of the reference voltage circuit, and that amplifies the difference between input voltages. The gain adjustment means also includes an integrating circuit that comprises a capacitor and an inverting amplifier, takes in the output of the first differential amplifier, and feeds back into the ion current voltage converter. The high frequency component amplifier comprises a second differential amplifier that shares its input terminals with the first differential amplifier and an output circuit that converts the output of the second differential amplifier into voltage to output.

In the gain adjustment means, the first differential amplifier compares the detected voltage of the ion current voltage converter with the predetermined reference voltage to amplify their difference voltage. Then the result is input to the integrating circuit, and the component currents of frequencies not less than a particular frequency are blocked and negatively fed back into the ion current voltage converter. By this means, the component currents of frequencies not less than a predetermined frequency are extracted. The extracted high frequency components are amplified by the second differential amplifier in the high frequency component amplifier.

In an internal combustion engine comprising ignition coils that generate high voltage on their secondary winding by a voltage applied to their primary winding, ignition plugs that fire by the voltage generated on ignition coils, and cylinders, a second ion current detecting apparatus in accordance with the present invention is equipped with an ion current detecting means that detects ion current generated inside cylinders to output signal a first output converted into voltage at a fixed rate and a second output signal converted into voltage at variable rate, an ion current magnitude detector that detects the magnitude of ion current by the first output signal of the ion current detecting circuit and outputs an ion current detection signal when the magnitude is greater than a predetermined value, a delay means that delays the ion current detection signal by a predetermined interval, a gain adjustment means that controls the rate of conversion for the second output signal in the ion current detecting means, a high frequency component amplifier that converts the component currents of frequencies not less than a predetermined frequency and superimposed in the waveform of ion current into voltage to output as a high frequency component detection signal, a comparison output means that compares the delayed ion current detection signal output from the delay means with the high frequency component detection signal and outputs the high frequency component detection signal only when the delayed ion current detection signal indicates the existence of ion current.

The ion current detecting means has a first capacitor that is charged with voltage for ion current detection by the voltage generated on the primary winding of the ignition coils and an ion current voltage converter that detects ion current generated inside the cylinders by applying the voltage generated by the discharging of the first capacitor to the ignition plugs and that outputs the first and second outputs. The gain adjustment mean has a third differential amplifier that amplifies the difference voltage between the second output of the ion current detecting means and the reference voltage and an integrating circuit that comprises a second capacitor and an amplifier and that takes in the output of the third differential amplifier to feed back into the ion current voltage converter. The high frequency component amplifier has a fourth differential amplifier that shares its input terminals with the third differential amplifier.

The gain adjustment means controls the rate of conversion from current to voltage for the second output of the ion current detecting means by feeding back the output signal of the integrating circuit into the ion current voltage converter and keeps the magnitude of currents of frequencies not greater than a predetermined frequency. By means of the fourth differential amplifier, the high frequency component amplifier amplifies and converts the component currents of frequencies not less than a predetermined frequency and superimposed in the waveform of ion current into voltage to output as a high frequency component detection signal.

Preferably, in the second ion current detecting apparatus, the ion current voltage converter comprises a first transistor, a second transistor whose base is connected to the base of the first transistor, a control circuit whose one end is connected to the emitter of the first transistor and whose other end is connected to the emitter of second transistor and that controls the emitter current of the second transistor, and a third transistor that shares its base and emitter respectively with the base and emitter of the first transistor. When ion current flows through the collector of the first transistor, the electric potentials at the collectors of the second and third transistors vary. Then the electric potential at the collector of the third transistor is output as the first output, and the electric potential at the collector of the second transistor is output as the second output.

Preferably, in the second ion current detecting apparatus, the control circuit comprises a resistor. The electric potential at the emitter of the second transistor is controlled by the voltage drop at the resistor, depending on the feedback amount output from the gain adjustment means.

Preferably, the second ion current detecting apparatus further has an engine speed detecting means that detects engine speed, raises the threshold value for ion current detection if the detected engine speed is faster than a predetermined value, and lowers the threshold value for ion current detection if the detected engine speed is not faster than the predetermined value.

Preferably, in the second ion current detecting apparatus, the engine speed detecting means comprises a capacitor that is charged by the voltage generated on the ignition coils during each ignition time to generate a holding voltage proportional to engine speed and a charging circuit that charges the capacitor, and the threshold value is controlled by feeding back a current proportional to the holding voltage of the capacitor into the ion current detecting means.

Preferably, in the first or second ion current detecting apparatus, a plurality of diodes are connected in parallel to the first capacitor with their cathodes connected to each other and with their anodes connected to a plurality of ignition coils. By this means, the first capacitor can be charged by a plurality of ignition coils.

Preferably, in the second ion current detecting apparatus, the gain adjustment means is equipped with a third capacitor connected in series between the second capacitor and the output terminal of the third differential amplifier and a resistor whose one end is connected to the connection between the second capacitor and the third capacitor and whose other end is grounded. By this means, the frequency characteristic in the integrating circuit is made steep.

BRIEF DESCRIPTION OF THE DRAWINGS

These and other objects and features of the present invention will become clear from the following description taken in conjunction with the preferred embodiments thereof and the accompanying drawings throughout which like parts are designated by like reference numerals, and in which.

DETAILED DESCRIPTION OF THE PREFERRED EMBODIMENTS

The preferred embodiments according to the present invention will be described below in conjunction with the attached drawings.

First Embodiment

Figure 1:
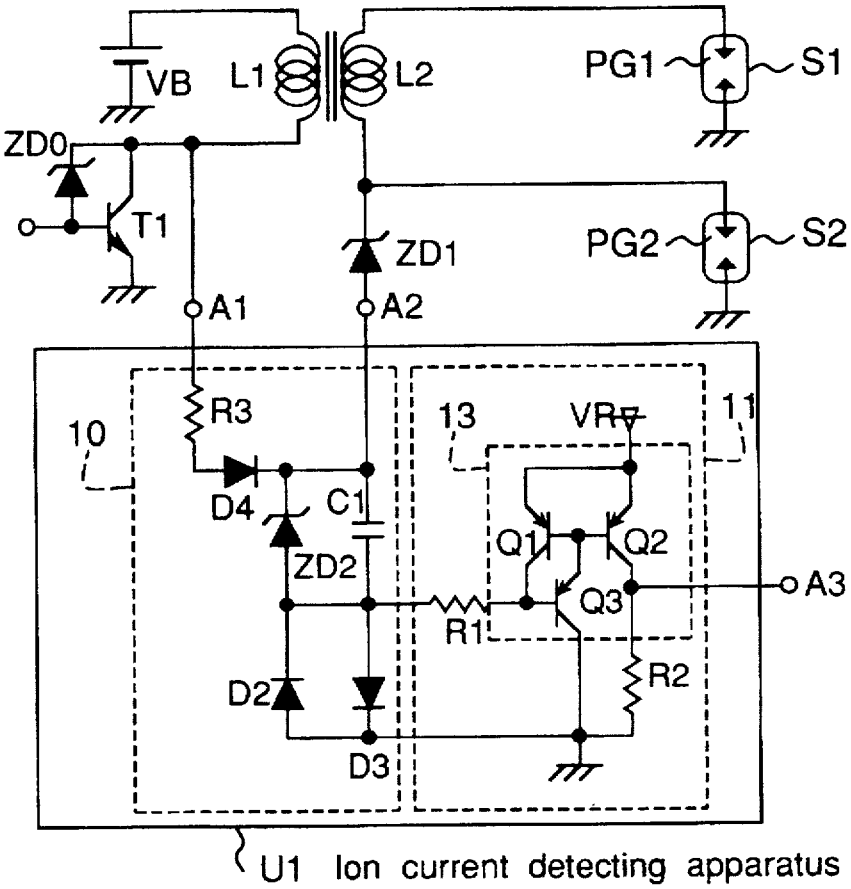
FIG. 1 is a circuit diagram of the ion current detecting apparatus of a first embodiment in accordance with the present invention.

FIG. 1 shows the ion current detecting apparatus of a first embodiment of the present invention. FIG. 1 illustrates an ignition system of the simultaneous ignition method and an ion current detecting apparatus U1 connected thereto. The ignition system comprises an ignition plug PG1 in a cylinder S1, an ignition plug PG2 in a cylinder S2, ignition coils with their primary winding L1 and secondary winding L2, a battery Vb, an ignition transistor T1, and Zener diodes ZD0, ZD1. One end of the primary ignition coil L1 is connected to battery Vb, and the other end is connected to the collector of switching transistor T1, which controls the current of the primary ignition coil L1. The other end of the primary ignition coil L1 is also connected to the cathode of Zener diode ZD0 and a terminal A1. The base of transistor T1 is connected to the anode of Zener diode ZD0. This base is fed with an ignition control signal from a computer unit, abbreviated to ECU hereafter, for ignition control. Zener diode ZD0 restricts a voltage applied to transistor T1. One end of the secondary ignition coil L2 is connected to ignition plug PG1, and the other end is connected to ignition plug PG2. Further, the cathode of Zener diode ZD1 is connected to the connection between the secondary ignition coil L2 and ignition plug PG2. The anode of Zener diode ZD1 is connected to a terminal A2. Zener diode ZD1 prevents a current from flowing from inside the cylinders S1, S2 to ion current detecting apparatus U1 during ignition. Ion current detecting apparatus U1 is composed of a voltage generator 10 for detection and a current detector 11 and connected to the ignition system through terminals A1 and A2.

Voltage generator 10 comprises a resistor R3 connected to terminal A1, a diode D4, whose anode is connected to the other end of resistor R3 and whose cathode is connected to terminal A2, a Zener diode ZD2, whose cathode is connected to terminal A2, a diode D2, whose cathode is connected to the anode of Zener diode ZD2 and whose anode is grounded, a capacitor C1, whose one end is connected to terminal A2 and whose other end is connected to the anode of zener diode ZD2, and a diode D3, whose anode is connected to the cathode of diode D2 and whose cathode is grounded.

Current detector 11 comprises a power supply VR, resistors R1, R2, and an ion current to voltage converter 13 composed of PNP transistors Q1, Q2, and Q3. One end of resistor R1 is connected to the connection between capacitor C1 and the anode of diode D3 of voltage generator 10, and the other end is connected to the collector of transistor Q1 and the base of transistor Q3. The emitters of transistors Q1 and Q2 are connected to each other, and the bases of transistors Q1 and Q2 are also connected to each other. The collector of transistor Q2 is connected to terminal A3. The collector of transistor Q3 is grounded. One end of resistor R2 is connected to the collector of transistor Q2, and the other end is grounded.

In the following is described the operation of ion current detecting apparatus U1 of the present embodiment. When transistor T1 is on, the primary ignition coil L1 is provided with a voltage, and a current flows through it. If transistor T1 is turned off from this state by the ignition control signal from ECU, then a counter electromotive force occurs in the primary ignition coil L1, so that the collector voltage of transistor T1 rises. The collector voltage of transistor T1 is controlled by Zener diode ZD0, so that it does not rise above a constant value, approximately 300 V. At this time, a high voltage of tens of kilovolts is generated on the secondary ignition coil L2. The high voltage generated on the secondary ignition coil L2 is applied to cylinders S1 and S2, so that electric sparks are generated by ignition plugs PG1 and PG2.

When electric sparks are taking place, the voltage at terminal A2 is about 300 V in voltage generator 10, and the voltage at the cathode of Zener diode is several to tens of kilovolts. At this time, a current flows through the path of terminal A1, to resistor R3, to diode D4, to capacitor C1, to diode D3 and to ground, so that capacitor C1 is charged. The voltage of capacitor C1 rises during the charging. However, when the voltage reaches the Zener voltage of Zener diode ZD2, Zener diode ZD2 sets off an avalanche, so that a current flows through the path of terminal A1, to resistor R3, to diode D4, to Zener diode ZD2, to diode D3→ground. Therefore, the voltage of capacitor C1 is maintained at a constant level.

The high voltage generated on the secondary ignition coil L2 falls with time and eventually becomes zero. When the voltage of the secondary ignition coil L2 becomes zero, the electric potentials at ignition plugs PG1 and PG2 become the same and equal to the sum of the holding voltage of capacitor C1 and the forward voltage of Zener diode ZD1. If ignition and combustion normally take place in cylinders S1 and S2, and ion current flows, then a current flows through the path of power source VR to transistor Q1, to resistor R1, to capacitor C1, to Zener diode ZD1 and to ignition plug PG2, or through the path of power source VR, to transistor Q1, to resistor R1, to capacitor C1, to Zener diode ZD1, to secondary ignition coil L2 and to ignition plug PG1.

At this time, the ion current generated inside cylinders S1 and S2 becomes equal to the collector current of transistor Q1, so that a current proportional to the collector current of transistor Q1 flows through the collector of transistor Q2 by an effect of the current mirror circuit. For example, if transistors Q1 and Q2 have the same characteristic, then an identical current flows. We assume that the transistors of any current mirror circuit described in the following descriptions have the same characteristic. Then an electric potential equivalent to the voltage drop at resistor R2 occurs at the collector of transistor Q2 by the collector current. This means that a detected ion current is converted into voltage in the ion current to voltage converter 13 having the current mirror composed of transistors Q1, Q2, and Q3. Therefore, a voltage proportional to ion current can be tapped from terminal A3 in a range where transistor Q2 is not saturated.

Here it is required to set the voltage of power supply VR at approximately the same value as the sum of the base emitter voltages of transistors Q1 and Q3. The reason is as follows. If the voltage of power supply VR is too low, then transistor Q3 is saturated, so that the collector current of transistor Q1 becomes lower than actually generated ion current. On the other hand, if the voltage of power supply VR is too high, then a stationary current flows through the path of transistor Q1, to transistor Q3, to resistor R1, to diode D3 and to ground, so that minute ion current cannot be detected.

In this way, the ion current detecting apparatus of the present embodiment can detect ion current generated inside cylinders, so that the detection of misfiring can be performed by the existence and non existence of the detected ion current.

Second Embodiment

Figure 2:
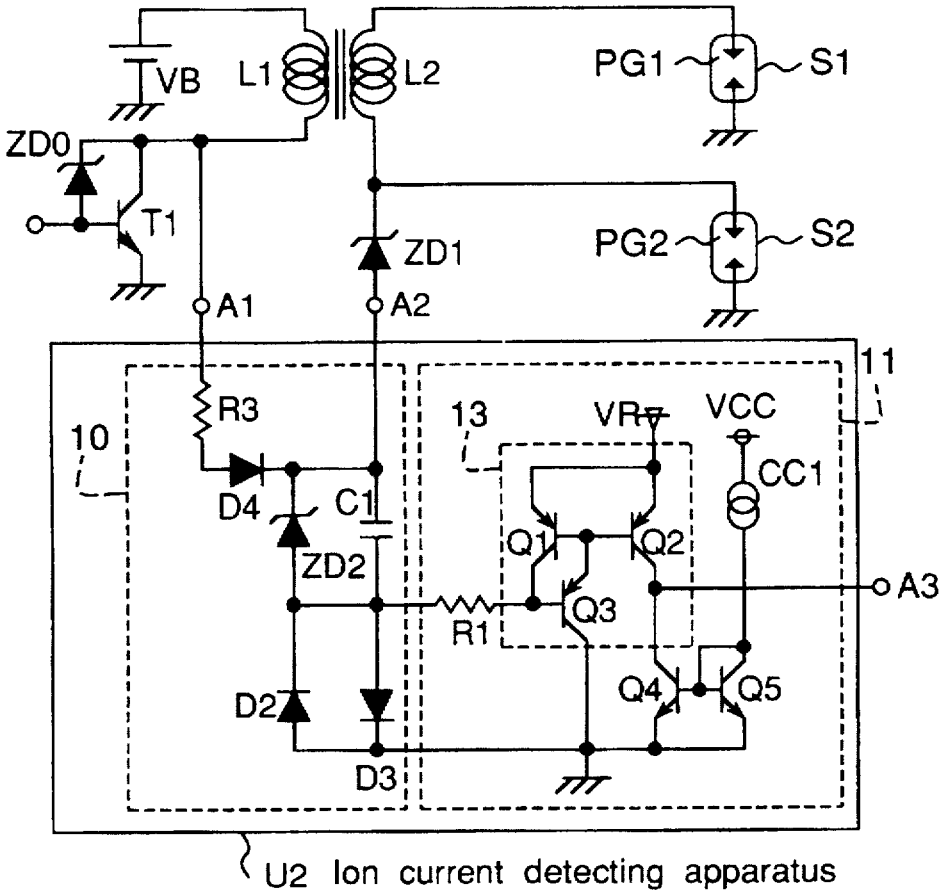
FIG. 2 is a circuit diagram of the ion current detecting apparatus of a second embodiment in accordance with the present invention.

FIG. 2 shows the ion current detecting apparatus of a second embodiment in accordance with the present invention. As illustrated in the figure, the ion current detecting apparatus U2 of the present embodiment has a current mirror circuit composed of NPN transistors Q4 and Q5 in place of the resistor R2 in the ion current detecting apparatus U1 of the first embodiment. The ion current detecting apparatus of the present embodiment also has an additional constant current source CC1.

A current determined by constant current source CC1 flows through the collector of transistor Q5. Since transistors Q4 and Q5 constitute a current mirror circuit, an identical current flows through the collector of transistor Q4. Therefore, the voltage at the connection between the collector of transistor Q2 and the collector of transistor Q4 is determined by the collector currents of transistor Q2 and transistor Q5. If the collector current of transistor Q2 is greater than the collector current of transistor Q5, then the voltage at the connection becomes the value obtained by subtracting the saturation voltage of transistor Q2 from the voltage of power supply VR. If the collector current of transistor Q2 is smaller than the collector current of transistor Q5, then the voltage at the connection becomes equal to the saturation voltage of transistor Q5.

As described above, when ion current is generated inside cylinders S1 and S2, then a current proportional thereto flows as a collector current of transistor Q2. Since ion current is minute, it is required in the ion current detecting apparatus U1 of the first embodiment that the resistance value of the resistor R2 for converting to voltage is made great. On the other hand, in the ion current detecting apparatus U2 of the present embodiment, ion current can be detected with high sensitivity by means of a current mirror circuit.

Third Embodiment

Figure 3:
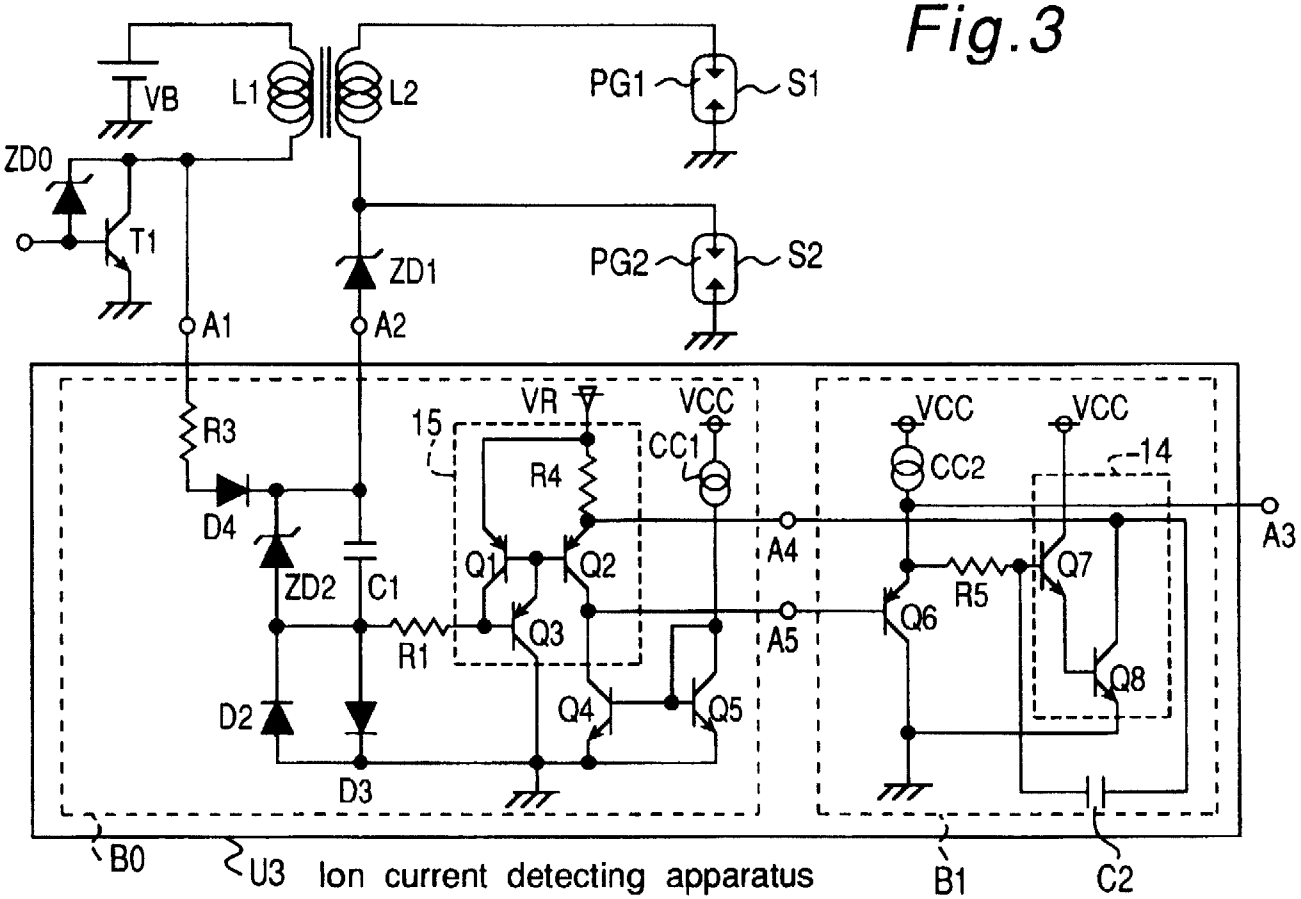
FIG. 3 is a circuit diagram of the ion current detector of a third embodiment in accordance with the present invention.

FIG. 3 shows the ion current detecting apparatus of a third embodiment in accordance with the present invention. The ion current detecting apparatus U3 of the present embodiment has a function of extracting a knock signal component superimposed in the waveform of an ion current signal.

The ion current detecting apparatus U3 of FIG. 3 comprises an ion current detecting circuit B0 that detects ion current and a knock signal extracting circuit B1 that extracts currents of frequencies not less than a predetermined frequency as a knock signal from the detected ion current. Ion current detecting circuit B0 is constructed by adding a resistor R4 between the emitter of transistor Q2 and power supply VR in the ion current detecting apparatus U2 of FIG. 2. In Ion current detecting circuit B0, resistor R4 and transistors Q1, Q2, Q3 constitute a current to voltage converter 15 that generates a voltage proportional to the generated ion current. A current proportional to the collector current of transistor Q1 flows through the collector of transistor Q2. The knock signal extracting circuit B1 has a PNP transistor Q6, whose emitter is connected to constant current source CC2 and whose collector is grounded, an inverting amplifier 14 composed of NPN transistors Q7 and Q8, and an integrating circuit composed of a resistor R5 and a capacitor C2. The base of transistor Q6 is connected to a terminal A5, and its emitter is connected to the input terminal of inverting amplifier 14 through resistor R5.

The operation of the ion current detecting apparatus U3 of the present embodiment is described in the following. When ion current is generated inside cylinders S1 and S2, a current flows through the path of transistor Q1 to resistor R1, to capacitor C1, and to terminal A2. At this time, in ion current to voltage converter 15, a current proportional to the collector current of transistor Q1 flows through the collector of transistor Q2. If the collector current of transistor Q2 exceeds the collector current of transistor Q4 determined by the current mirror circuit composed of transistors Q4 and Q5, then the electric potential at the collector of transistor Q2 rises. When the electric potential at the collector of transistor Q2 rises, the electric potential at the base of transistor Q6 rises, so that the electric potential at the emitter of transistor Q6 rises. When the electric potential at the emitter of transistor Q6 rises, the electric potential at the base of transistor Q7 rises, so that transistor Q7 is turned on. When transistor Q7 is turned on, the electric potential at the base of transistor Q8 rises, so that transistor Q8 is turned on. When transistor Q8 is turned on, a current flowing through the path of power supply VR to resistor R4, and to transistor Q8 is established, so that the voltage drop at resistor R4 becomes great. As a result, the electric potential at the emitter of transistor Q2 declines, and the collector current of transistor Q2 becomes smaller than the collector current of transistor Q1. In this way, the ratio of current flowing through the collector of transistor Q1 to the current flowing through the collector of transistor Q2 can be varied by controlling the collector current of transistor Q2 with transistors Q7 and Q8. Therefore, the conversion rate in ion current voltage converter 15 composed of transistors Q1, Q2, and Q3 can be controlled with transistors Q7 and Q8. In the present embodiment, the collector current of transistor Q2 is controlled by inducing a voltage drop at resistor R4. However, instead of using resistor R4, a circuit that controls the electric potential at the emitter of transistor Q2 with the collector current of transistor Q8 can be used.

Further, transistors Q7 and Q8 constitute the inverting amplifier 14 that amplifies the variation of the electric potential at the base of transistor Q7 to convert into the variation of the electric potential at the collector of transistor Q8. Then inverting amplifier 14, capacitor C1, and resistor R4 constitute an integrating circuit. Concerning the variation of electric potential at the emitter of transistor Q6, this integrating circuit blocks a signal of frequencies greater than the cut off frequency in the integrating circuit and negatively feeds it back into the emitter of transistor Q2. By this means, a current corresponding to high frequency components, with frequencies greater than the cut off frequency, of the collector current of transistor Q1 flows through the collector of transistor Q2. This means that the frequency components representing the knock signal superimposed in the ion current can be extracted by detecting the voltages at both ends of resistor R5.

In the present embodiment, an inverting amplifier using transistors Q7 and Q8 is used. If an operational amplifier is used in place of the inverting amplifier, similar effects can be obtained.

Fourth Embodiment

Figure 4:
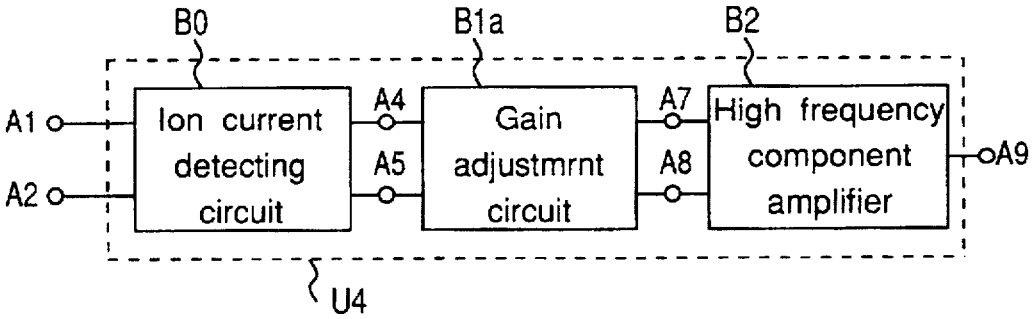
FIG. 4 is a block diagram illustrating the circuitry of the ion current detecting apparatus of a fourth embodiment in accordance with the present invention.

FIG. 4 is a block diagram of the ion current detecting apparatus of a fourth embodiment in accordance with the present invention. The ion current detecting apparatus U4 of the present embodiment comprises an ion current detecting circuit B0 that detects ion current, a gain adjustment circuit B1*a* that keeps constant the magnitude of components of detected ion current having frequencies not greater than a predetermined frequency, and a high frequency component amplifier B2 that extracts and amplifies components of the output signal of the gain adjustment circuit having frequencies not less than a predetermined frequency. Here ion current detecting circuit B0 is the same construction as in the third embodiment.

Figure 5:
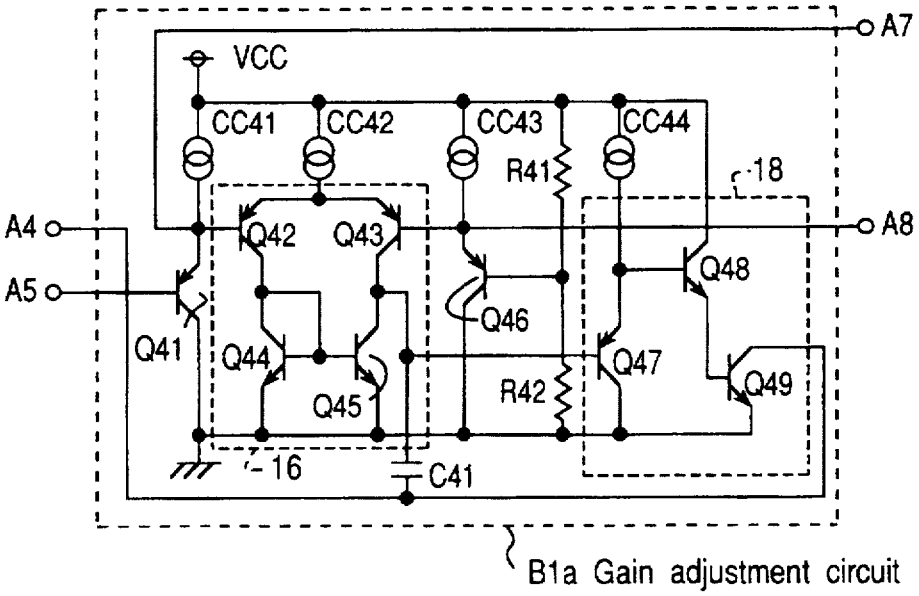
FIG. 5 is a circuit diagram of the gain adjustment circuit in the ion current detecting apparatus of the fourth embodiment.

FIG. 5 shows a circuit diagram of gain adjustment circuit B1*a*. Gain adjustment circuit B1*a* is constructed by the connective relation shown in FIG. 5 from a differential amplifier 16, an inverting amplifier composed of NPN transistors Q47, Q48, and Q49, resistors R41, R42, PNP transistors Q41, Q46, a capacitor C41, and constant current sources CC41 to CC44. Differential amplifier 16 is constructed from a differential pair composed of PNP transistors Q42 and Q43, whose emitters are jointly connected to constant current source CC42, and a current mirror circuit composed of NPN transistors Q44 and Q45. One input terminal of differential amplifier 16 is connected to the emitter of transistor Q41 and fed with a voltage corresponding to the variation of the electric potential at the base of transistor Q41. The other input terminal of differential amplifier 16 is connected to the emitter of transistor Q46. The electric potential at the base of transistor Q46 is fixed at a constant value determined by the ratio of the resistance values of resistors R41 and R42, so that the electric potential at the emitter of transistor Q46 is also fixed at a constant value. Therefore, the electric potential at the base of transistor 43 is fixed at a constant value. Here the electric potential at the base of transistor Q46 is required to be set within the range of variation in the electric potential at the collectors of transistors Q42 and Q44, so that it is set at a middle level of the voltage of power supply VR.

Figure 6:
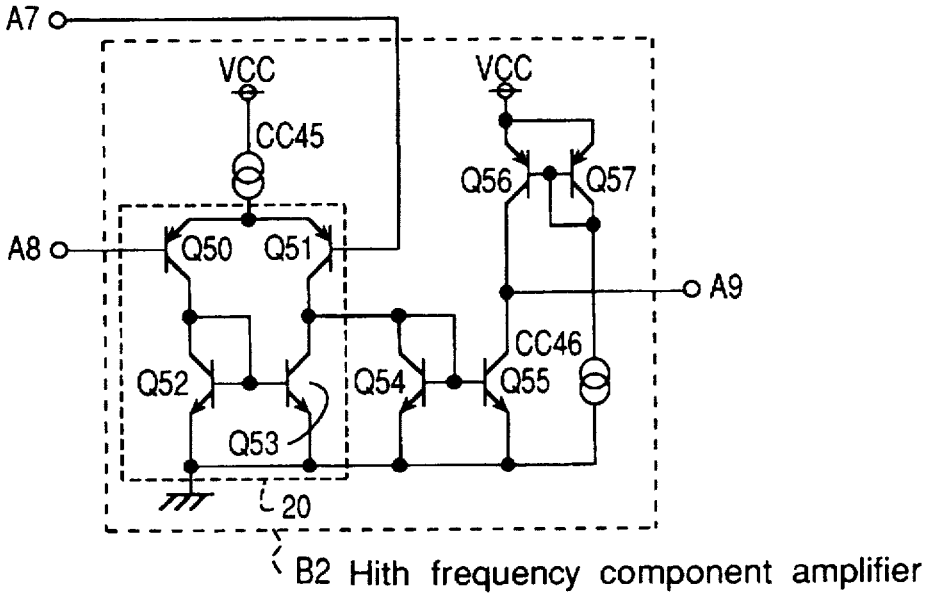
FIG. 6 is a circuit diagram of the high frequency component amplifier in the ion current detecting apparatus of the fourth embodiment.

FIG. 6 shows a circuit diagram of the high frequency component amplifier B2. The high frequency component amplifier B2 is constructed by the connective relation shown in FIG. 6 from a differential amplifier 20, a current mirror circuit composed of NPN transistors Q54 and Q55, a current mirror circuit composed of PNP transistors Q56 and Q57, and constant current sources CC45 and CC46. Differential amplifier 20 is constructed from a differential pair composed of PNP transistors Q50 and Q51, whose emitters are jointly connected to constant current source CC45, and a current mirror circuit composed of NPN transistors Q52 and Q53. One input terminal of differential amplifier 20 is connected to a terminal A8, and the other input terminal is connected to a terminal A7.

The operation of ion current detecting apparatus U4 of the present embodiment is described in the following. When ion current is detected, and the electric potential at the collector of transistor Q2 in ion current detecting circuit B0 rises, the electric potential at the base of transistor Q41 rises through terminal A5, so that the electric potential at the emitter of transistor Q41 rises. As a result, the electric potential at the base of transistor Q42 rises, and the collector current of transistor Q42 decreases. The sum of collector currents of transistors Q42 and Q43 is determined at a constant by constant current sources CC42, so that the collector current of transistor Q43 increases. The collector current of transistor Q44 also decreases by the decline of collector current of transistor Q42. Since transistors Q44 and Q45 constitute a current mirror circuit, the collector current of Q45 decreases. Therefore, the collector current of transistor Q43 becomes greater than the collector current of transistor Q45, so that the electric potential at the collector of transistor Q43 rises, and the electric potential at the base of transistor Q47 rises. When the electric potential at the base of transistor Q47 rises, transistors Q48 and Q49 are turned on. Transistors Q48 and Q49 constitute an integrating circuit together with capacitor 41. As described in the third embodiment, this integrating circuit performs negative feedback control of the electric potential at the emitter of transistor Q2 in ion current detecting circuit B0. In the present embodiment, by the difference between the collector currents of transistors Q43 and Q45, capacitor C41 is charged and discharged, and the frequency characteristic of the integrating circuit is also determined. In this way, the electric potential at the collector of transistor Q2 is controlled by the electric potential at the voltage dividing point between resistors R41 and R42, so that if a high frequency component due to knocking is superimposed in ion current, then the signal component due to the knocking appears at the collector of transistor Q2 with its level centered around the electric potential at the voltage dividing point of resistors R41 and R42.

The knock signal component appearing at the collector of transistor Q2 in the high frequency component amplifier B2 is input to one input terminal of differential amplifier 20 through transistor Q41 and terminal A7. A voltage determined by resistors R41, R42 and transistor Q46 is input to the other input terminal of differential amplifier 20. When a difference between the electric potentials at the bases of transistors Q50 and Q51 occurs caused by the oscillation of the knock signal, the difference current between the collector currents of the transistors Q50 and Q51 is output as the collector current of transistor Q55 by the current mirror circuit composed of transistors Q54 and Q55. The collector current of transistor Q55 is converted from current into voltage by the current mirror circuit composed of transistors Q56 and Q57 to be output as a two valued output through a terminal A9. That is, if a high frequency component due to knocking is detected, then a signal at high level, abbreviated to "H" hereafter, is output through terminal A9. If high frequency components are not detected, then a signal at low level, abbreviated to "L" hereafter, is output.

Here if the collector current of Q50, Q51, and Q55 are respectively denoted by IC50, IC51, and IC55, then the following equation holds.

$$IC55=IC51-IC50. \quad (1)$$

Further, the charging/discharging current of capacitor C41 is equal to the difference current between the collector currents of transistors Q42 and Q43. Corresponding to this difference current, a difference voltage between the bases of transistors Q42 and Q43 occurs. The bases of transistors Q50 and Q51 are respectively connected to the bases of transistors Q43 and Q42 in differential amplifier 16 of gain adjustment circuit B1*a*. Therefore, the difference voltage between the bases of transistors Q50 and Q51 becomes equal to the difference voltage between the bases of transistors Q42 and Q43. If the charging/discharging current of capacitor C41 is denoted by Ich, and if the currents of constant current sources CC42 and CC45 are respectively denoted by ICC42 ad ICC45, then the following equation holds.

$$IC55=ICH\times(ICC45/ICC42). \quad (2)$$

Therefore, if ICC45>ICC42, then the charging/discharging current of capacitor C41 is amplified and extracted as the collector current of transistor Q55 to be output through terminal A9 as a two valued output, as described above.

In the third embodiment, it is necessary to set the resistance value of resistor R4 in the integrating circuit at a large value to increase the sensitivity of the knock signal. In the ion current detecting apparatus U4 of the present embodiment, a resistor of a high resistance value is not necessary, since the knock signal is detected by a differential amplifier and a capacitor. Consequently, an ion current detecting apparatus suitable for an integrated circuit can be realized.

Fifth Embodiment

When ion current is detected, during the transient period from the state of generating a spark at an ignition plug by ignition coils to the state of detecting ion current, a current caused by a rapid change in the electric potential and the floating capacity at the ignition plug flows for a short time of about several hundred microseconds. This current is not due to ion current and becomes a cause of false detection. The ion current detecting apparatus of a fifth embodiment does not detect knocking, when an ion current that does not last longer than a predetermined interval during knock detection. By detecting knocking only when ion current lasts longer than the predetermined interval, the ion current detecting apparatus prevents false detection and improves the accuracy of knock detection. The ion current detecting apparatus of the present embodiment is equipped with a function of detecting misfiring (ion current detection) and a function of detecting knocking and uses the circuit and operation for misfiring detection also for knock detection to improve accuracy in detecting a knock signal.

Figure 7:
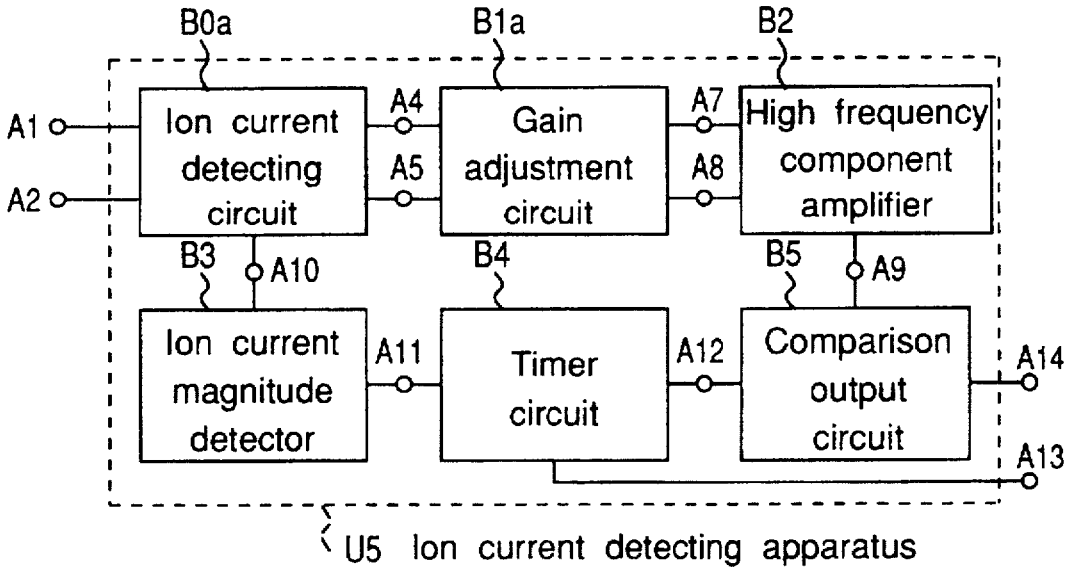
FIG. 7 is a block diagram illustrating the circuitry of the ion current detecting apparatus of a fifth embodiment in accordance with the present invention.

FIG. 7 shows a circuit diagram of the ion current detecting apparatus U5 of the present embodiment. In FIG. 7, ion current detecting apparatus U5 comprises an ion current detecting circuit B0*a*, a gain adjustment circuit B1*a*, a high frequency component amplifier B2, an ion current magnitude detector B3, a timer circuit B4, and a comparison output circuit B5.

In the ion current detecting apparatus U5 of the present embodiment, ion current detecting circuit B0*a* detects ion current generated inside cylinders. Gain adjustment circuit B1*a* keeps constant the magnitude of the components of detected ion current having frequencies not greater than a predetermined frequency, and the high frequency component amplifier B2 extracts and amplifies the components of the output signal of gain adjustment circuit B1*a* having frequencies not less than a predetermined frequency to convert into voltage. Ion current magnitude detector B3 compares the ion current measured in ion current detecting circuit B0*a* with a predetermined magnitude, judges whether an ion current not less than the predetermined magnitude has been detected, and outputs an ion current detection signal. Timer circuit B4 delays the detection signal output from ion current magnitude detector B3 by a predetermined interval. Comparison output circuit B5 compares the high frequency components of ion current output from the high frequency component amplifier B2 with the ion current detection signal delayed by a predetermined interval and output from timer circuit B4. Comparison output circuit B5 then detects knocking and output a knock detection signal, only when ion current is detected.

Figure 8:
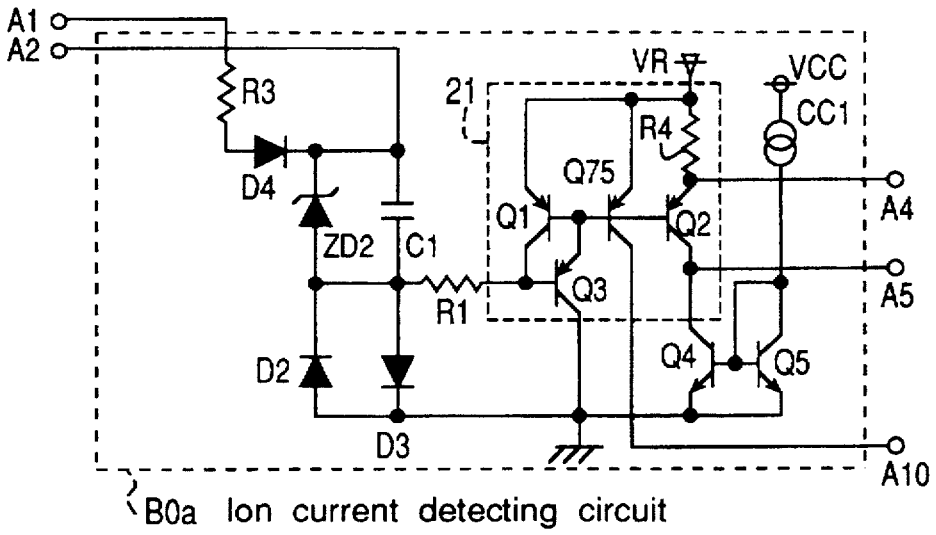
FIG. 8 is a circuit diagram of the ion current detecting circuit in the ion current detecting apparatus of the fifth embodiment.

Each circuit block constituting the present embodiment is described in the following. The Gain adjustment circuit B1*a* and the high frequency component amplifier B2 are the same as those in the fourth embodiment, so that their descriptions are omitted. FIG. 8 shows a circuit diagram of the ion current detecting circuit B0*a*. The ion current detecting circuit B0*a* is constructed by adding a PNP transistor Q75 to the ion current detecting circuit B0 shown in FIG. 3. Here the base and emitter of transistor Q75 are respectively connected to the base and emitter of transistor Q1, so that Q1 and Q75 form a current mirror circuit. The collector of Q75 is connected to a terminal A10. Transistors Q1, Q2, Q3, and Q75 constitute an ion current voltage converter 21 that generates a voltage proportional to generated ion current. Since transistors Q75 and Q1 constitute a current mirror circuit, if a current flows through the collector of transistor Q1, then an identical current flows through the collector of transistor Q75. The identical current can be tapped through terminal A10.

Figure 9:
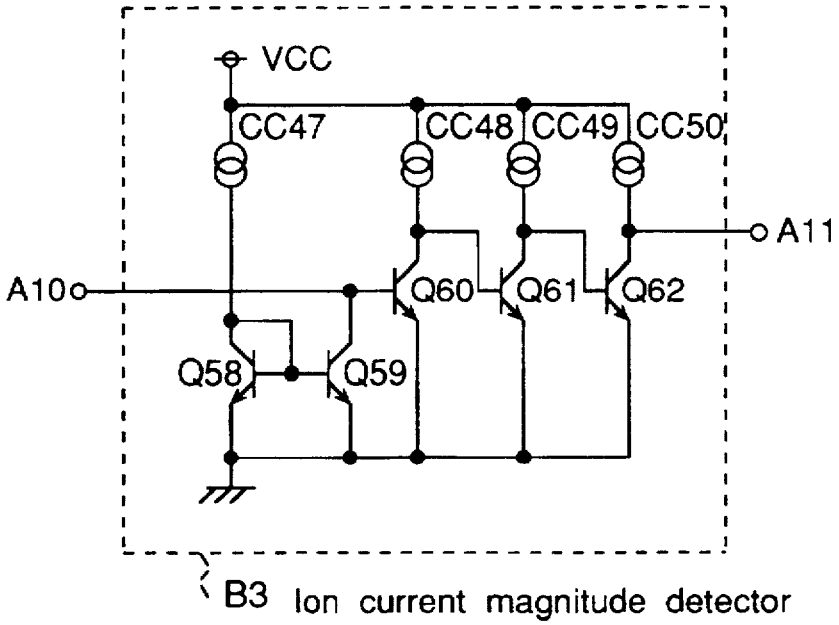
FIG. 9 is a circuit diagram of the ion current magnitude detector in the ion current detecting apparatus of the fifth embodiment.

FIG. 9 shows ion current magnitude detector B3. Ion current magnitude detector B3 is constructed by the connective relation shown in FIG. 9 from a current mirror circuit composed of NPN transistors Q58, Q59, NPN transistors Q60, Q61, and Q62, and constant current sources CC47, CC48, CC49, and CC50. The emitters of transistors Q58, Q59, which constitute a current mirror, are grounded. The collector of transistor Q58 is connected to a power line through constant current source CC47. The collector of transistor Q59 is connected to terminal A10 and the base of transistor Q60. The collector of transistor Q60 is connected to the base of transistor Q61. The collector of transistor Q61 is connected to the base of transistor Q62. The emitters of transistors Q60, Q61, and Q62 are grounded. The collectors of transistors Q60, Q61, and Q62 are connected to the power line VCC respectively through constant current sources CC48, CC49, and CC50. The collector of transistor Q62 is also connected to a terminal A11.

The operation of the present circuit is described in the following. When ion current is detected in ion current detecting circuit B0*a*, the detected current flows through the base of transistor Q60 through terminal A10. At this time, if the ion current is greater than the current determined by the current mirror circuit composed of transistors Q58 and Q59, then transistor Q60 is turned on. Then transistor Q61 is turned off, and transistor Q62 is turned on. As a result, a signal at "L" is output through terminal A11. If the ion current is less than the current determined by the current mirror circuit composed of transistors Q58 and Q59, then transistor Q60 is turned off. Then transistor Q61 is turned on, and transistor Q62 is turned off. As a result, a signal at "H" is output through terminal A11.

Figure 10:
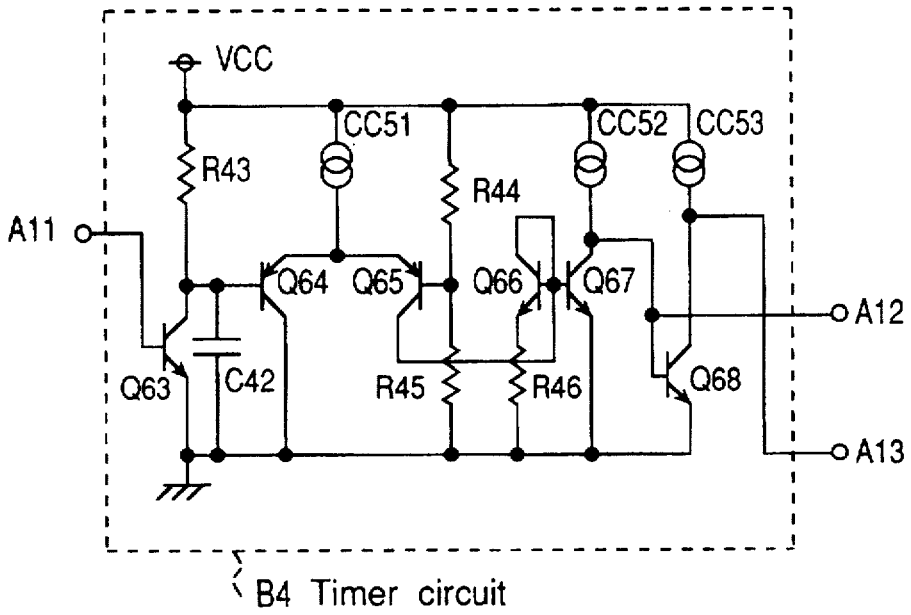
FIG. 10 is a circuit diagram of the timer circuit in the ion current detecting apparatus of the fifth embodiment.

FIG. 10 shows a circuit diagram of timer circuit B4. Timer circuit B4 has a differential pair composed of PNP transistors Q64 and Q65 and a leak cut circuit composed of NPN transistors Q66, Q67 and a resistor R46. Timer circuit B4 is constructed by the connective relation shown in FIG. 10 from the differential pair, the leak cut circuit, transistors Q63, Q68, resistors R43, R44, R45, a capacitor C42, and constant current sources CC51, CC55, CC56, CC57. Here the leak cut circuit makes timer circuit B4 not operational at minute current. The base of transistor Q64 in the differential pair is connected to the collector of transistor Q63. The base of transistor Q65 is connected to the connection between resistors R44 and R45. The collector of transistor Q65 is connected to the base of transistor Q67 in the leak cut circuit. Capacitor C42 is inserted between the base of transistor Q64 and ground, and resistor R43 is inserted between the base of transistor Q64 and the power line VCC. The base of transistor Q64 is connected to terminal A11, through which an ion current detection signal is input from the ion current magnitude detector. The collector of transistor Q67 is connected to a terminal A12, through which an ion current detection signal is output into comparison output circuit B5. The collector of transistor Q68 is connected to a terminal A13, through which a misfiring detection signal is output.

The operation of the present circuit is described in the following. When a signal at "L" is input through terminal A11, transistor Q63 is turned off, so that capacitor C42 is charged with a current flowing through resistor R43. The electric potential at the base of transistor Q64 rises, as capacitor C42 is charged. The electric potential at the base of transistor Q65 is determined by the resistance values of resistors R44 and R45 and the voltage value of power line VCC. If the electric potential at the base of transistor Q64 rises beyond the electric potential at the base of transistor Q65, then the collector current transistor Q65 increases, so that transistor Q67 is turned on. When transistor Q67 is turned on, transistor Q68 is turned off, so that a signal at "H" is output through terminal A13. In summary, if a signal at "L" is input through terminal A11, then after a interval during which the electric potential at the base of transistor Q64 rises beyond a predetermined electric potential at the base of transistor Q65, a signal at "H" is output through terminal A13. This delay time is determined by the capacity value of capacitor C42, the resistance value of resistor R43, and the electric potential at the base of transistor Q65.

On the other hand, if a signal at "H" is input through terminal A11, transistor Q63 is turned on, so that capacitor C42 is discharged with the collector current of transistor Q63, and the electric potential at the base of transistor Q64 falls. If the electric potential at the base of transistor Q64 falls below the electric potential at the base of transistor Q65, then the collector current transistor Q65 decreases, so that transistor Q67 is turned off. When transistor Q67 is turned off, transistor Q68 is turned on, so that a signal at "L" is output through terminal A13.

Figure 11:
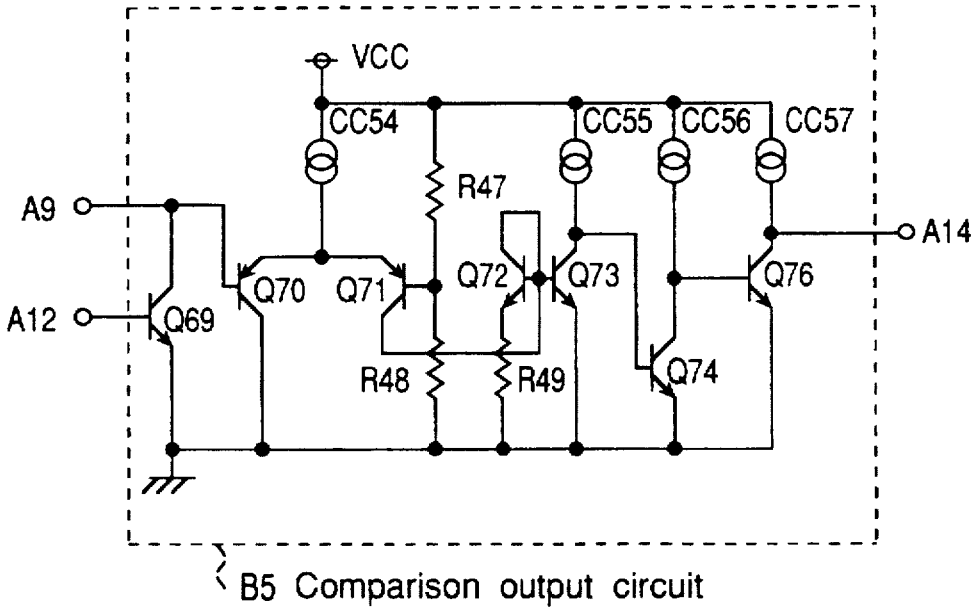
FIG. 11 is a circuit diagram of the comparison output circuit in the ion current detecting apparatus of the fifth embodiment.

FIG. 11 shows a circuit diagram of comparison output circuit B5. Comparison output circuit B5 has a differential pair composed of transistors Q70, Q71 and a leak cut circuit composed of NPN transistors Q72, Q73, and a resistor R49. Comparison output circuit B5 is constructed by the connective relationship shown in FIG. 11 from the differential pair, the leak cut circuit, NPN transistors Q69, Q74, Q76, resistors R47, R48, and constant current sources CC54, CC55, CC56, CC57. The base of transistor Q70 in the differential pair is connected to the collector of transistor Q69. The base of transistor Q71 is connected to the connection between resistors R47 and R48. The collector of transistor Q71 is connected to the base of transistor Q73 in the leak cut circuit. The collector of transistor Q76 is connected to a terminal A14, through which a knock detection signal is output.

The operation of comparison output circuit B5 is described in the following. Comparison output circuit B5 compares the high frequency component detection signal output from the high frequency component amplifier B2 with the ion current detection signal output from timer circuit B4 to detect knocking only when an ion current of duration longer than a predetermined interval is flowing.

When a signal at "H" is input to the base of transistor Q69 through terminal A12, transistor Q69 is turned on, and the electric potential at the collector of transistor Q55 in the high frequency component amplifier B2 is kept at the saturation voltage of transistor Q69, so that high frequency components are not detected. In fact, if the electric potential at the collector of transistor Q69 is low, so that the electric potential at the base of transistor Q70 becomes lower than the electric potential at the base of transistor Q71, then the collector current of transistor Q71 decreases, so that transistor Q73 is turned off. Then transistor Q74 is turned on, and transistor Q76 is turned off, so that a signal at "H" is output through terminal A14.

On the other hand, when a signal at "L" is input to the base of transistor Q69 through terminal A12, transistor Q69 is turned off, and the electric potential at the base of transistor Q70 corresponds to the electric potential of the high frequency component detection signal output from the high frequency component amplifier B2 through terminal A9. When high frequency components contained in the ion current are detected, so that a high frequency component detection signal at "H" is input through terminal A9, the electric potential at the base of transistor Q70 rises. If the electric potential at the base of transistor Q70 rises beyond the electric potential at the base of transistor Q71, then the collector current of transistor Q71 increases, so that transistor Q73 is turned on. When transistor Q73 is turned on, transistor Q74 is turned off, and then transistor Q76 is turned on. Therefore, at this time, a signal at "L" is output through terminal A14. In summary, when transistor Q69 is off, a knock signal at "L" is output through terminal A14, if high frequency components are detected corresponding to the high frequency component detection signal input from the high frequency component amplifier B2.

As described so far, in the ion current detecting apparatus of the present embodiment, when ion current is detected, the ion current magnitude detector B3 outputs a signal at "L." Then timer circuit B4 delays the signal, and outputs a signal at "L" into comparison output circuit B5. Then comparison output circuit B5 obtains the logical sum of the "L" output from timer circuit B5 and the inverse of the high frequency component detection signal output from the high frequency component amplifier B2, so that a knock detection signal is output if an ion current of duration longer than a predetermined interval is detected. That is, if high frequency components are detected, a signal at "L" is output as a knock detection signal through terminal A14. On the other hand, if an ion current of duration longer than the predetermined interval is not detected, then ion current magnitude detector B3 outputs a signal at "H," which is input to comparison output circuit B5 through timer circuit B4. Then comparison output circuit B5 outputs a signal at "H" through terminal A14.

As described above, the ion current detecting apparatus U5 of the present invention performs the detection of ion current and the extraction of high frequency components of the detected ion current and delays the ion current detection signal by a predetermined interval to compare with the extracted high frequency components. By these means, the ion current detecting apparatus cancels a current flowing for an extremely short time to prevent false detection. In this way, the ion current detecting apparatus simultaneously performs ion-current detection (misfiring) and knock detection, and can detect knocking with great accuracy without using an externally provided masking signal for knock detection.

Sixth Embodiment

The ion current detecting apparatus of a sixth embodiment detects engine speed to feed back a current for preventing false detection depending on engine speed into detected ion current. Consequently, the ion current detecting apparatus can realize the detection of misfiring for a wide range of engine speed.

Figure 12:
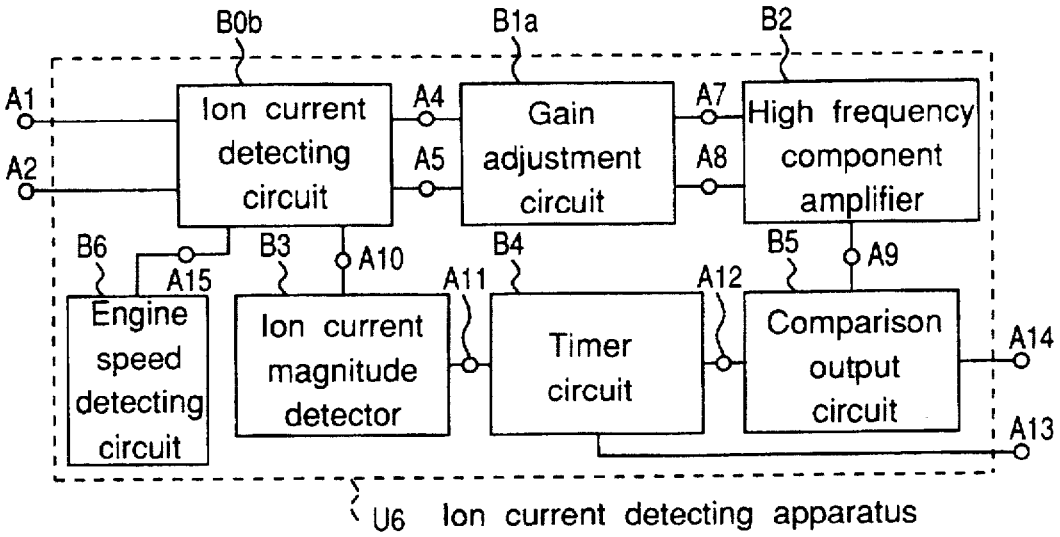
FIG. 12 is a block diagram illustrating the circuitry of the ion current detecting apparatus of a sixth embodiment in accordance with the present invention.

FIG. 12 shows a circuit diagram of the ion current detecting apparatus U6 in the present embodiment. Ion current detecting apparatus U6 comprises an ion current detecting circuit B06, a gain adjustment circuit B1*a*, a high frequency component amplifier B2, an ion current magnitude detector B3, a timer circuit B4, a comparison output circuit B5, and an engine speed detecting circuit B6.

Figure 13:
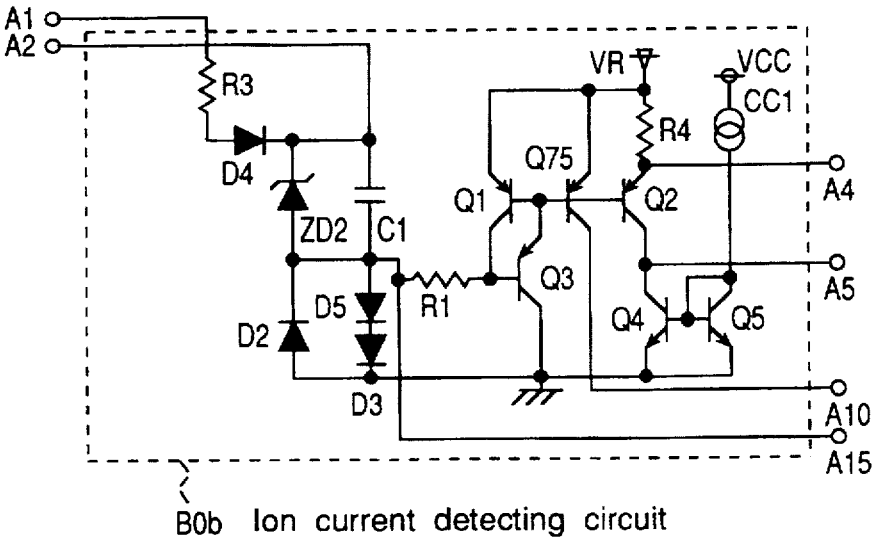
FIG. 13 is a circuit diagram of ion current detecting circuit in the ion current detecting apparatus of the sixth embodiment.

Ion current detecting circuit B0*b* is constructed as shown in FIG. 13. It has an additional diode D5 in series between the diode D3 and the capacitor C1 of the ion current detecting circuit B0*a* shown in FIG. 8. The diode D5 is inserted to obtain the activating voltage of an transistor Q77 in the engine speed detecting circuit B6.

Figure 14:
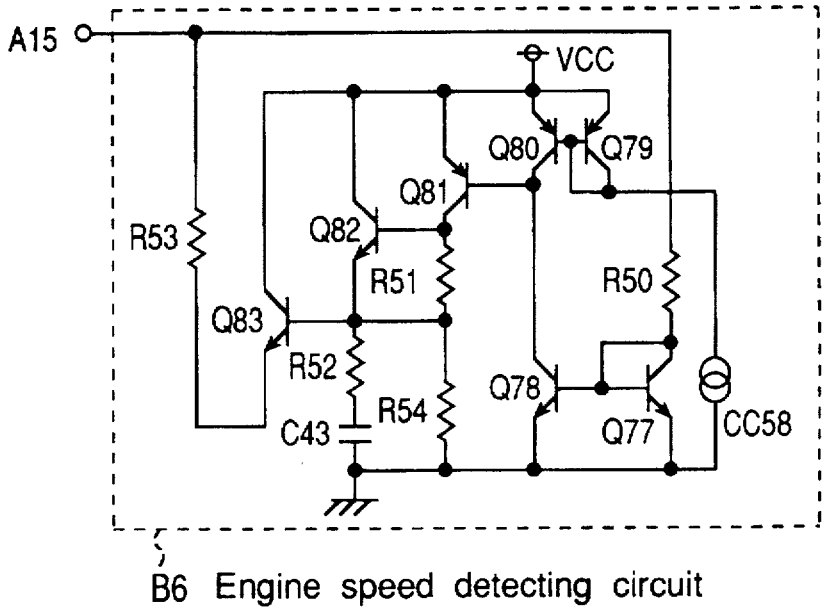
FIG. 14 is a circuit diagram of the engine speed detecting circuit in the ion current detecting apparatus of the sixth embodiment.

FIG. 14 shows a circuit diagram of engine speed detecting circuit B6. Engine speed detecting circuit B6 is constructed by the connective relationship shown in FIG. 14 from a current mirror circuit composed of NPN transistors Q77, Q78, a current mirror circuit composed of PNP transistors Q79, Q80, a PNP transistor Q81, NPN transistors Q82, Q83, resistors R50, R51, R52, and R53, a capacitor C43, and a constant current source CC58. The collector of transistor Q77 in a current mirror circuit is connected to a terminal A15 through resistor R50, and a current depending on engine speed is input through terminal A15. The emitter of transistor Q53 is connected to a terminal A15 through resistor R53, and a feedback current proportional to engine speed is output through terminal A15.

The operation of the present circuit is described in the following. At the time of ignition, in ion current detecting circuit B0*b*, capacitor C1 is charged by the voltage on the primary ignition coil L1, so that a charging current flows for a very short time of about tens of microseconds and hundreds of microseconds through the path of terminal A1 to resistor R3, to diode D4, to capacitor C1, to diode D5, to diode D3, and to ground, as already described. At this time, in engine speed detecting circuit B6, a current flows through the path of terminal A15 to resistor R50, to transistor Q77, and to ground. The collector current flowing through transistor Q77 at this time is determined by the forward voltage drop at diodes D3 and D5 due to the charging current, the resistance value of resistor R55, and the characteristic of transistor Q77. Since transistors Q77, Q78 constitute a current mirror circuit, a current identical to the collector current of transistor Q77 flows through the collector of transistor Q78. Since transistors Q79, Q80 also constitute a current mirror circuit, a current determined by constant current source CC58 flows through the collector of transistor Q80. Therefore, when the collector current of transistor Q78 becomes greater than the collector current of transistor Q80, the junction between the base and the emitter of transistor Q81 is forward biased, so that a current flows through the base. The collector current of transistor Q81 becomes the base current of transistor Q82, and, amplified by transistor Q82, flows into capacitor C43 through resistor R52. If the maximum value of the emitter current of transistor Q82 is sufficiently large, then the charging current of capacitor C43 is limited by resistor R52 and the holding voltage of capacitor C43.

When ignition finishes and ion current is detected, the charging current of capacitor C1 decreases, and the electric potential at terminal A15 becomes zero by the operation of transistors Q1, Q3. Therefore, the collector current of transistor Q78 decreases, and transistor Q80 is saturated, since the path for its collector current is blocked. Then the voltage between the base and the emitter of transistor Q81 becomes the saturation voltage of transistor Q80, so that transistor Q81 is turned off. When transistor Q81 is turned off, transistor Q82 is turned off. Then capacitor C43 stops charging and pours current into resistor R54 or the base of transistor Q83 with its discharging. In this way, capacitor C43 is charged during firing and discharged during non firing. If the capacity value of capacitor C43 is sufficiently large, the amount of the charge is greater than the amount of the discharge, so that the holding voltage of capacitor C43 rises.

The charging period of capacitor C1 is determined by the current flowing through the primary ignition coil and the inductance of the ignition coils. It is approximately a constant of about tens of microseconds to hundreds of microseconds. As described above, if the capacity value of capacitor C43 is sufficiently large, then the charging at one ignition time does not saturate capacitor C43, and its holding voltage rises by a constant value at each ignition time. Therefore, when engine speed is high, the period of ignition becomes short, so that the holding voltage becomes higher in proportion to engine speed. When engine speed is low, the period of ignition becomes long, so that the holding voltage of capacitor C43 does not become higher.

If the holding voltage of capacitor C43 becomes high, and the junction between the base and the emitter of transistor Q83 is forward biased, then the emitter current of transistor Q83 is fed back into terminal 15 through resistor R53. This feedback current is determined by the holding voltage of capacitor C43, the forward voltage drop between the base and emitter of transistor Q83, the resistance value of resistor R52, and the electric potential at terminal A15. Therefore, a high resistor of about tens of KΩ to several MΩ is used as resistor R52, so that the feedback current is made not greater than the collector current of transistor Q80.

In this way, when engine speed is low, the holding voltage of capacitor C43 is low, so that the feedback current becomes small. When engine speed is high, the holding voltage of capacitor C43 is high, so that the feedback current becomes large. The ion current detected by the collector of transistor Q1 in ion current detecting circuit B0*b* is reduced by the feedback current. Therefore, the threshold value for ion current to be detected can be varied depending on engine speed. In the present embodiment, the charging of capacitor C43 is performed during the time when the current flowing into the capacitor is beyond a predetermined magnitude. Alternatively, a circuit may be used such that the charging of a capacitor is performed for a predetermined interval when the current flowing into the capacitor becomes greater than a predetermined magnitude.

Seventh Embodiment

Figure 15:
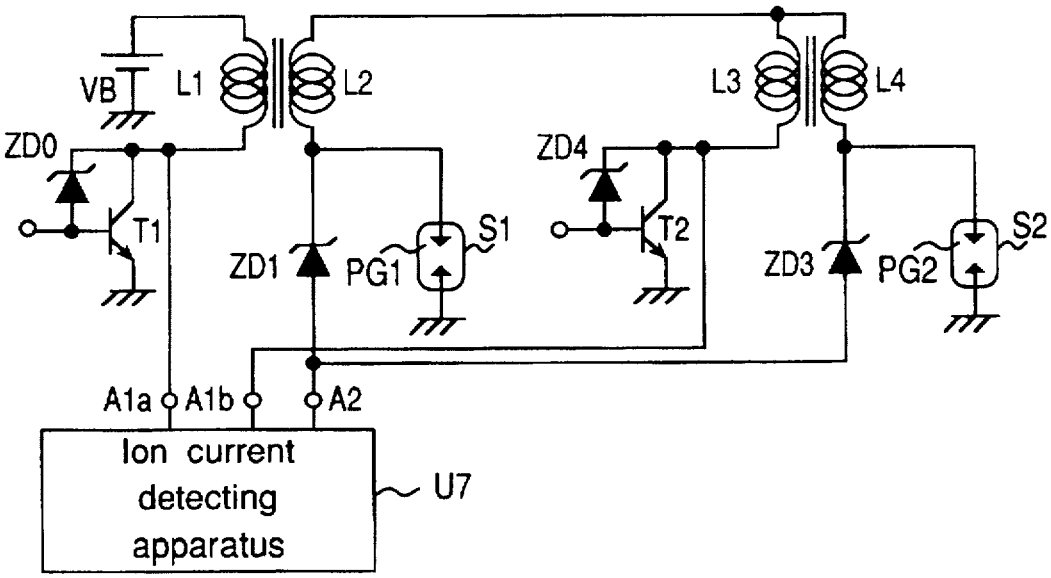
FIG. 15 is a circuit diagram illustrating an application of the ion current detecting apparatus of a seventh embodiment to an ignition circuit of the individual ignition method.
Figure 16:
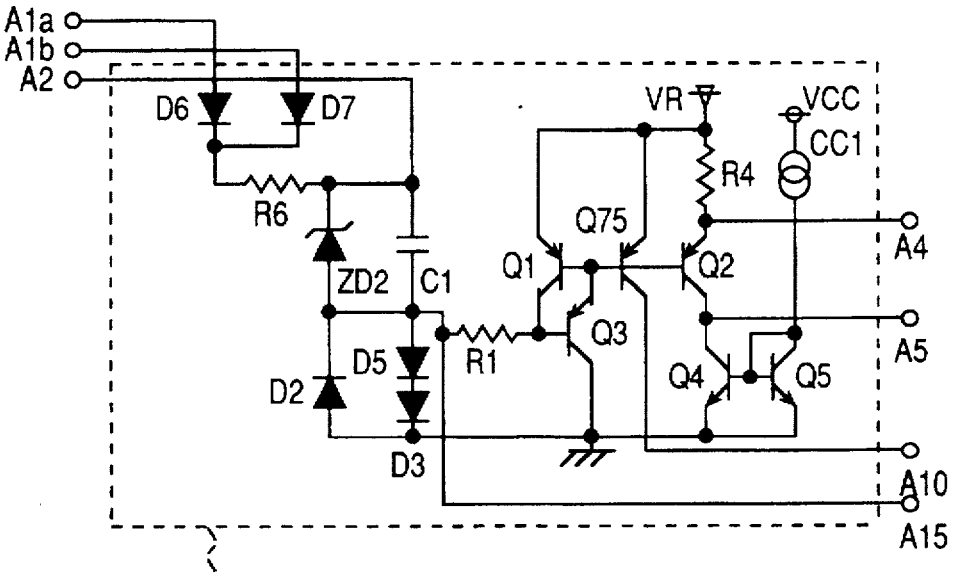
FIG. 16 is a circuit diagram of the ion current detecting circuit in the ion current detecting apparatus of the seventh embodiment.

The ion current detecting apparatus of a seventh embodiment is for the use in an ignition circuit of the individual ignition method, as shown in FIG. 15. In the present embodiment, an ion current detecting circuit B0*c* shown in FIG. 16 is used in place of the ion current detecting circuit B0*b* in the ion detecting apparatus U6 of the sixth embodiment. Ion current detecting circuit B0*c* is constructed by replacing the resistor R3 and the diode D4 in the ion detecting circuit B0*b* shown in FIG. 13 with a resistor R6, whose one end is connected to the cathode of Zener diode ZD2, a diode D6, whose cathode is connected to the other end of resistor R6, and whose anode is connected to a terminal A1*a*, and a diode D7, whose anode is connected to a terminal A1*b*, and whose cathode is connected to the cathode of diode D6. In the individual ignition method, ignition is independently controlled for each ignition plug as shown in FIG. 15, so that ignition coils L1, L2, L3, L4 and transistors T1 and T2 for generating an electromotive force on ignition coils L1, L3 are installed for the independent control of each plug. Therefore, during the time when ignition plug PG1 fires, capacitor C1 is charged through the path of terminal A1*a* to diode D6, and to resistor R6. During the time when ignition plug PG2 fires, capacitor C1 is charged through the path of terminal A1*b* to diode D7 and to resistor R6. Using the charged capacitor C1, a current is poured into cylinders immediately after ignition, so that ion current and knocking can be detected in the operation described above.

Eighth Embodiment

Figure 17:
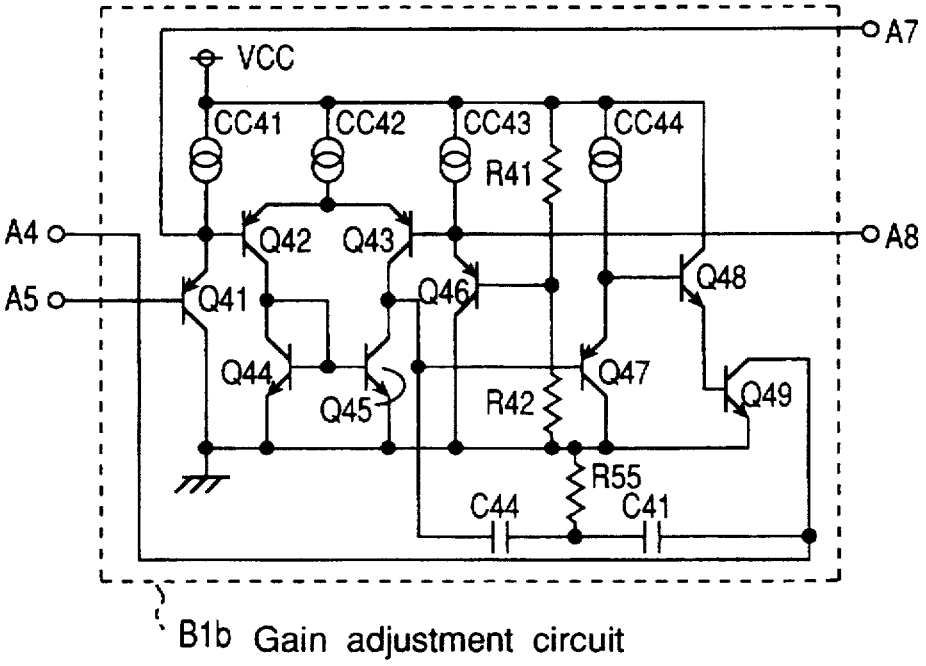
FIG. 17 is a circuit diagram of the gain adjustment circuit in the ion current detecting apparatus of an eighth embodiment.

The ion current detecting apparatus of an eighth embodiment further reduces false knock detection in the ion current detecting apparatus of the sixth embodiment. It is configured by using a gain adjustment circuit B1*b* shown in FIG. 17 in place of the gain adjustment circuit B1*a* in the ion current adjustment circuit U6 of the sixth embodiment. Gain adjustment circuit B1*b* of the present embodiment is constructed from the circuit B1*a* of FIG. 5 by inserting a capacitor C44 in series between capacitor C41 and the collector of transistor Q45, and grounding the connection between capacitor C44 and capacitor C41 through a resistor R55. A knock signal has a characteristic frequency of the engine, so that it generates a vibration of a particular narrow frequency rage. The knock signal component superimposed in the ion current is similar, so that a filter characteristic is required for knock detection. In the ion current detecting apparatus of the sixth embodiment, the filter characteristic is determined by the capacity value of capacitor C41. However, the range of passed frequencies is wide. Therefore, if oscillating component currents other than a knock component are superimposed, they may be detected as a knock signal. Constructed from the circuit shown in FIG. 17, the present embodiment makes the filter characteristic steep to increase the attenuated magnitude of components other than the knock signal component and prevent thereby the false detection of knock signals.

In the ion current detecting apparatus of the above embodiments, application to an ignition circuit of the simultaneous ignition method was described except in the seventh embodiment. However, by establishing a plurality of current paths, each comprising terminal A2, a diode, whose anode is connected to terminal A2 and whose cathode is connected to a ignition plug, and the ignition plug, the present invention can be applied to an ignition circuit of the high voltage distribution method.

EFFECTS OF THE INVENTION

According to a first ion current detecting apparatus of the present invention, an ion current voltage converter is constructed by a current mirror circuit, so that ion current detection is made possible by a simple circuit.

According to the first ion current detecting apparatus of the preferred configurations, the ion current voltage converter can convert the detected ion current into voltage to output.

According to the first ion current detecting apparatus of the preferred configurations, the ion current voltage converter can convert the detected ion current into voltage to output with great accuracy by means of a current mirror circuit.

According to the first ion current detecting apparatus of the preferred configurations, a first ion current detecting circuit detects ion current, and a knock signal extracting circuit restricts the magnitude of component currents of detected ion current and of frequencies not greater than a predetermined frequency to negatively feed them back into the first ion current detecting circuit to extract component currents of frequencies greater than a predetermined frequency as a knock signal. By this means a knock signal can be extracted from ion current.

According to a second ion current detecting apparatus of the present invention, the detection of ion current (detection of misfiring) and the detection of a knock signal are simultaneously realized. The combination of an ion current magnitude detector, a high frequency component amplifier, a timer circuit, and a comparison output circuit performs masking for knock detection, so that the detection of a knock signal can be achieved without receiving an extra signal for masking to perform knock detection.

According to the second ion current detecting apparatus of the preferred configurations, ion current generated inside cylinders can be detected and output at a predetermined rate of current to voltage conversion and at a variable rate of current to voltage conversion.

According to the second ion current detecting apparatus of the preferred configurations, engine speed is detected, and a current proportional to the detected engine speed is fed back into a second ion current detecting circuit, so that knock detection can be achieved on the whole range of engine speed.

According to the second ion current detecting apparatus of the preferred configurations, in the engine speed detecting circuit, a capacitor is charged with a voltage generated on ignition coils during each ignition, to measure engine speed, so that engine speed can be measured as the holding voltage of the capacitor.

According to the first or second ion current detecting apparatus of the preferred configurations, in the ion current detecting circuit, a plurality of diodes can be installed to charge a capacitor for individual ignition coils independent of each other with voltage for detection, so that an ion current detecting apparatus that can be used for ignition systems of the individual ignition method can be realized.

According to the second ion current detecting apparatus of the preferred configurations, in a gain adjustment circuit, the frequency characteristic in the integrating circuit is made steep, so that the attenuation amount of component signals other than a knock signal can be made great.

Although the present invention has been fully described in connection with the preferred embodiments thereof and the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. An ion current detection apparatus for detecting an ion current caused between a cylinder of an internal combustion engine and an ignition plug insulated from the cylinder upon combustion which is caused when a high voltage is applied to the ignition plug, the high voltage being generated at a secondary coil of an ignition coil circuit when a voltage is applied to a primary coil of the ignition coil circuit, said ion current detection apparatus comprising:

a voltage generation circuit for generating and applying a detection voltage between the cylinder and the ignition plug, said voltage generation circuit comprising a first diode having an anode connected to the primary coil of the ignition coil circuit, a capacitor having a first end connected to a cathode of the first diode and being charged by a voltage generated at said primary coil, and a second diode having an anode connected to a second end of the capacitor and having a cathode that is grounded, for forming a charging circuit for charging the capacitor to generate the detection voltage together with the first diode; and an ion current voltage converter comprising a current mirror circuit to which an ion current is input and from which a current equivalent to the ion current is output and an output circuit for converting the current from the current mirror circuit to a voltage indicative of the ion current.

2. The ion current detection apparatus defined in claim 1 wherein the output circuit is composed of a resistor.

3. The ion current detection apparatus defined in claim 1 wherein the output circuit includes a constant current circuit having a current mirror circuit.

4. The ion current detection apparatus defined in claim 1 further comprising a gain adjustment means for controlling a rate of conversion from the ion current to the output voltage in said ion current voltage converter and a high frequency component amplifier for converting high frequency components superimposed in the ion current to a voltage.

5. The ion current detection apparatus defined in claim 4 wherein said gain adjustment means comprises a reference voltage circuit that generates a predetermined reference voltage, a first differential amplifier for amplifying a differential voltage between said reference voltage and said voltage output from said output circuit, and an integration circuit for integrating said differential voltage and feeding back an output of said integration circuit to said ion current voltage converter.

6. The ion current detection apparatus defined in claim 5 wherein said integration circuit comprises a capacitor and an inverting amplifier.

7. The ion current detection apparatus defined in claim 5 wherein said high frequency component amplifier comprises a second differential amplifier for amplifying said differential voltage between said reference voltage and said voltage output from said output circuit, and an output circuit for converting an output of said second differential amplifier to a voltage.

8. The ion current detection apparatus defined in claim 1, further comprising a plurality of diodes connected in parallel to the capacitor having a plurality of cathodes connected to each other and having a plurality of anodes connected to a plurality of ignition coils and, thereby, charging the capacitor by said plurality of ignition coils.

* * * * *